US006427556B2

(12) United States Patent
Fabbro

(10) Patent No.: US 6,427,556 B2
(45) Date of Patent: Aug. 6, 2002

(54) CENTERING DEVICE FOR CORKSCREW

(76) Inventor: Alberto Fabbro, Via Udine, 36, 33010 Cassacco (Ud) (IT)

( * ) Notice: Subject to any disclaimer, the term of this patent is extended or adjusted under 35 U.S.C. 154(b) by 0 days.

(21) Appl. No.: 09/915,370

(22) Filed: Jul. 27, 2001

(30) Foreign Application Priority Data

Aug. 8, 2000 (IT) ..... UD00A0151

(51) Int. Cl.[7] ..... B67B 7/62

(52) U.S. Cl. ..... 81/3.37; 81/3.2; 81/3.25; 81/3.36

(58) Field of Search ..... 81/3.37, 3.2, 3.29, 81/3.25, 3.47, 3.36, 3.48

(56) References Cited

U.S. PATENT DOCUMENTS

| | | | | | |
|---|---|---|---|---|---|
| 4,295,392 | A | * | 10/1981 | Peck | 81/3.3 |
| 4,527,450 | A | * | 7/1985 | Drosky | 81/3.29 |
| 4,926,717 | A | * | 5/1990 | Gomes | 81/3.2 |
| 4,955,261 | A | * | 9/1990 | Chiang | 81/3.2 |
| 5,003,844 | A | * | 4/1991 | Barrow | 81/3.2 |
| 5,040,437 | A | * | 8/1991 | Mueller | 81/3.2 |
| 5,095,778 | A | * | 3/1992 | Bocsi et al. | 81/3.2 |
| 5,367,923 | A | * | 11/1994 | Fabbro | 81/3.09 |
| 5,503,047 | A | * | 4/1996 | Brockington | 81/3.2 |
| 5,724,869 | A | * | 3/1998 | May | 81/3.2 |
| 6,282,985 | B1 | * | 9/2001 | Tseng | 81/3.29 |
| 6,321,620 | B1 | | 11/2001 | Fabbro | |

FOREIGN PATENT DOCUMENTS

| | | | | |
|---|---|---|---|---|
| DE | 55845 | * | 5/1891 | 81/3.37 |
| WO | 9952809 | | 10/1999 | |

* cited by examiner

*Primary Examiner*—Joseph J. Hail, III
*Assistant Examiner*—Hadi Shakeri
(74) *Attorney, Agent, or Firm*—Stevens, Davis, Miller & Mosher, LLP

(57) ABSTRACT

A device to center and align to the wormscrew of a corkscrew the neck of a bottle of any diameter whatsoever from which the cork is to be extracted, wherein a receptacle cone is located at the base of a collection tube and is retractable with respect to the latter in order to allow the neck of a bottle to abut always centered against the base of the tube in order to have a constant and determinate abutment position to correctly remove the cork and to be able to determine precisely and in advance how much the wormscrew has to penetrate into the cork itself.

12 Claims, 3 Drawing Sheets

CENTERING DEVICE FOR CORKSCREW

FIELD OF THE INVENTION

The invention concerns a device to center, at the base of a corkscrew, the upper part of the neck of a bottle from which it is intended to remove the cork.

This device is particularly indicated when it is intended to uncork bottles which have very different diameters at the upper end of the neck and particularly when it is desired to perform a controlled uncorking and hence to establish how much the wormscrew has to penetrate into the cork.

BACKGROUND OF THE INVENTION

Normally double-lever corkscrews or similar which are used to remove real or synthetic corks from a bottle have at the base, in correspondence and below the abutment point, a sort of conical cavity which serves as a receptacle for the upper part of the neck in order, in one way or another, to center the cork in correspondence with the tip of the wormscrew which must penetrate therein in order to subsequently remove it.

It is important that the wormscrew penetrates the center of the cork and perpendicularly; it is also important that the cork is removed in this direction, because screwing in the wormscrew laterally and obliquely is the main reason for breakages, both of the wormscrew and of the necks of the bottles.

From WO-A-99-52809 of the same Applicant, it is known a device to automatically uncork a bottle wherein it is possible to regulate how much the wormscrew has to penetrate into the cork in order to be able to remove it without making a hole in the base thereof, so as not to make bits of cork fall onto the liquid; moreover, with this system, when necessary, it is also possible to remove the cork only partly (partial uncorking), and the uncorking can be completed later manually when the bottle is to be used.

In order to obtain this result with the known method, it is indispensable that the upper part of the neck of the bottle always abuts at a fixed point, which will normally be the point, more or less, where the tip of the wormscrew reaches.

As long as traditional bottles with bulges (a thickening of the upper part of the neck) are used, which are normally between 33 and 27 mm in diameter, everything proceeds normally.

However, in recent years bottles of very different shapes have appeared on the market and, especially from the USA bottles have arrived which have necks widened at the top and which even reach 40 mm in diameter.

These bottles, with such abnormal thickenings, sometimes cannot even be included in the receptacle cone of a normal corkscrew.

To remove the cork of such bottles it is possible to widen the base of the cone and construct the receptacle almost plane in the abutment part.

But by doing this we shall never have a good centering, considering the differences in diameter with which we have to work.

On the contrary, if we widen only the base of the cone and extend it to receive any diameter, we shall certainly obtain a good centering, but while the bottles with a smaller diameter will abut at the right point where the tip of the wormscrew arrives, other bottles, with greater diameters, will go onto the wall of the cone and, according to the angle thereof, will abut and be located at different distances from the tip of the wormscrew according to the diameters of the various necks of the bottles.

These distances can also be several millimeters and this will no longer permit a controlled and regulated penetration of the wormscrew into the cork.

Bottles which are not well centered, are held oblique with respect to the wormscrew, are located at different distances from the correct abutment point, lead to extractions which cannot be regulated, are improperly carried out, and can even lead to the breakage of the wormscrew, or the cork or even the glass.

The present Applicant has found the method which we shall now describe, in order to overcome these shortcomings, to perform a correct and controlled uncorking and, as much as possible, to prevent breakages.

SUMMARY OF THE INVENTION

Normally a double-lever corkscrew comprises two vertical rods or a tube inside which the wormscrew turns parallel; the tube will serve to collect the cork once it has been removed from the bottle. It widens at the base under the tip of the wormscrew so as to form a cone which serves as a centering receptacle and its highest part acts as an abutment element for the neck of the bottle.

The tube and the conical receptacle are made in a single piece.

In this way every different diameter of the upper part of the neck of a bottle will abut on the walls of the cone at different distances from the tip of the wormscrew.

The present invention consists in having made of the tube and the conical receptacle two independent bodies in such a manner that the centering cone can slide upwards, outside the collection tube, once a bottle neck which is wider than normal is introduced therein and thrust in abutment.

With this device, the upper part of the neck will always abut centered on a well established point and that is on the lower part of the collection tube where, always in that position, there is the tip of the wormscrew which will have to penetrate into the cork.

BRIEF DESCRIPTION OF THE DRAWINGS

The functioning will be understood better with the description -and the attached drawings, which show preferential forms of embodiment, given as a non-restrictive example, which we shall complete by describing other characteristics of the invention for a better and more perfect functioning. In particular.

DETAILED DESCRIPTION OF THE INVENTION

Figure 1:
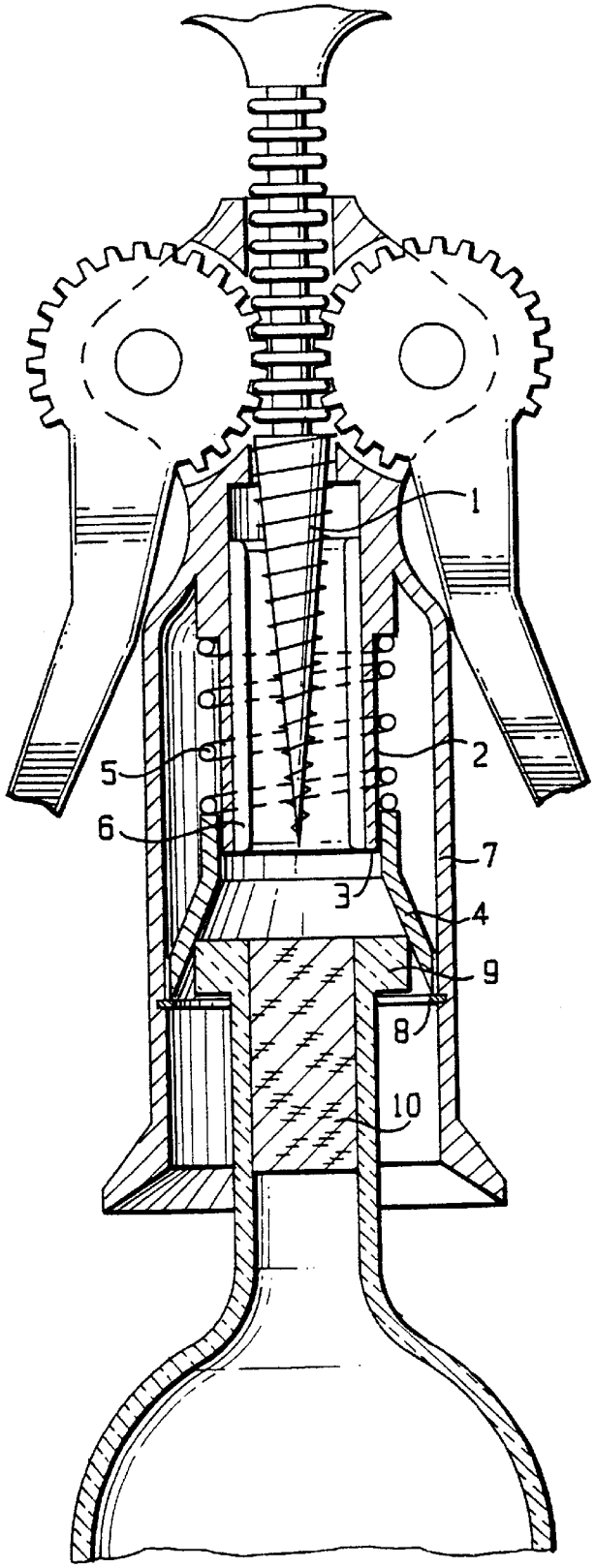
FIG. 1 shows a double-lever corkscrew or similar, inside which the neck of the bottle is introduced which is centered on the cone but which still has to be made to abut.

A preferential embodiment is shown in FIG. 1 where:

n. 1 represents the wormscrew n. 2 the tube which collects the cork n. 3 the base of the collection tube n. 4 the movable centering cone
n. 5 a spring
n. 6 two inner ribs inside the collection tube which serve to expel the cork
n. 7 outer shell
n. 8 stopper ring for the centering cone
n. 9 neck of the bottle
n. 10 cork It is easy to understand how the device according to the present invention, once the neck of the bottle 9 has been introduced at the base of the cone 4, whether the bottle itself is thrust upwards or whether the corkscrew is thrust towards the bottle, the upper part of the neck 9 goes first to abut on a part of the wall of the cone 4 to then center and subsequently, continuing to thrust the neck of the bottle 9 towards the corkscrew, or vice versa, will make the cone 4 axially retract with respect to the collection tube 2, until the upper part of the neck abuts on the base 3 of the collection tube 2.

All bottles of any diameter whatsoever will always abut, already centered, at that point (i.e. the base 3 of the collection tube 2) and therefore we shall have a certain base to decide how much to make the wormscrew 1 penetrate into the cork 10, according to the length of the latter and according to whether the bottle is to be totally or partially uncorked.

The spring 5 will serve to contrast the sliding of the cone 4 so that the latter will move only when the neck of the bottle 9 is well centered.

So far we have seen how to solve the problem of centering the bottles for different diameters of different necks, so as to have a well-defined centered abutment point.

As we have said, however, it is not enough to have a good abutment, it is also necessary to have the bottle aligned with the turn of the wormscrew 1 in the cork.

If it is a manual corkscrew, not fixed, it will be necessary to provide manually that the wormscrew 1 is aligned with the neck of the bottle 9 and, also manually, we shall have to evaluate how much to make the wormscrew 1 penetrate into the cork.

If, on the contrary, it is a corkscrew which is fixed to the wall or similar it is possible to arrange a V-shaped support, a few centimeters, e.g. about 13–14, below the mouth of the corkscrew, for the body of the bottle.

This support will serve to guide the bottle so that the neck 9 is centered and aligned with the wormscrew 1 which has to penetrate the cork 10.

Only in this way, from the cooperation of these two elements, the retractable cone 4 and the guide for the body of the bottle, shall we obtain a perfect centering for any diameter whatsoever of the neck 9 in alignment with the vertical sliding of the wormscrew 1; only in this way shall we have a certain and constant abutment point and be able to determine precisely and in advance how much we want to make the wormscrew penetrate into the cork 10, without pieces of cork falling into the liquid and without breakages.

Figure 2:
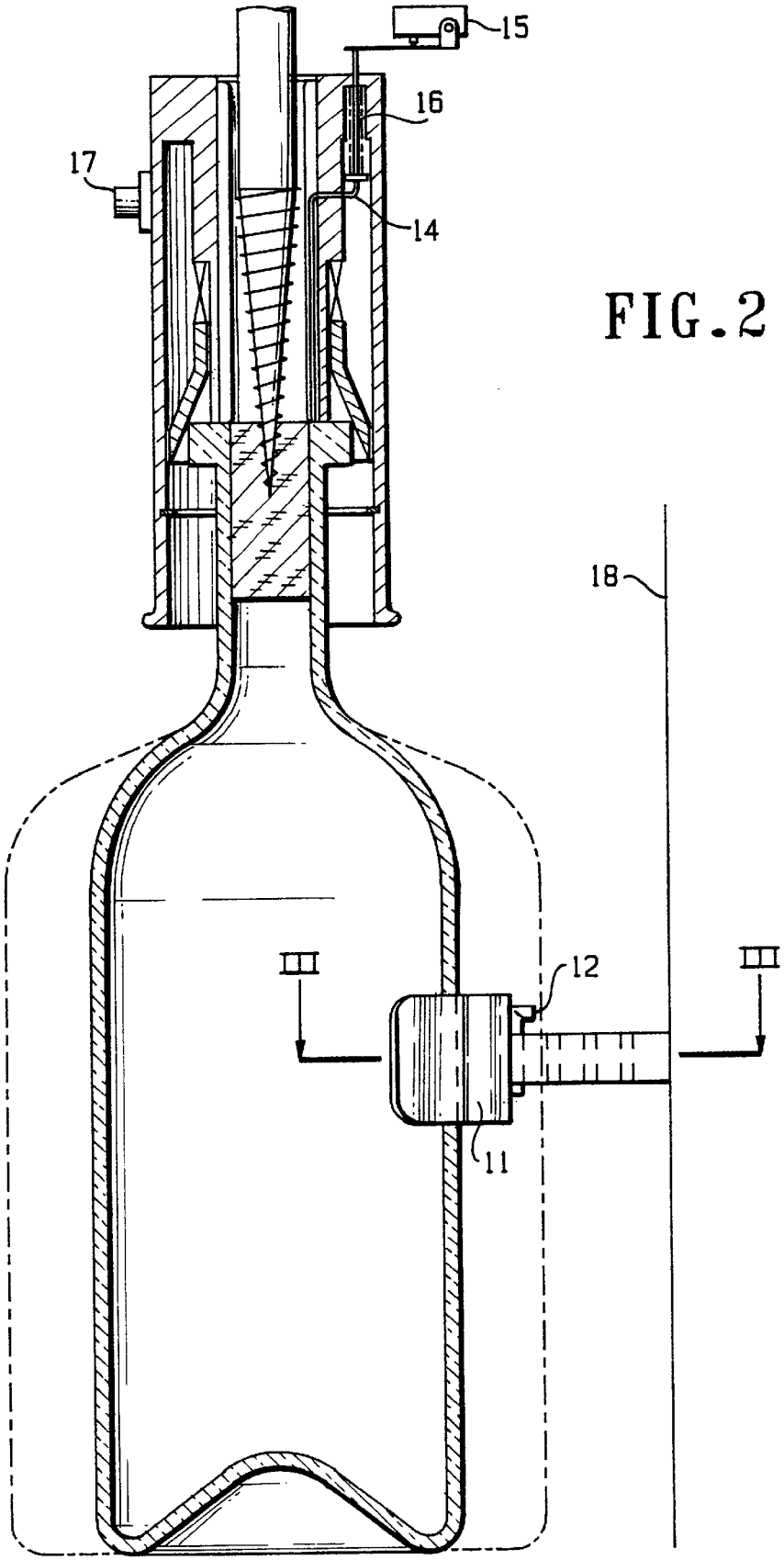
FIG. 2 shows a corkscrew similar to that in FIG. 1 where the neck of the bottle is in abutment on the base of the collection tube and the body of the bottle is guided by a V-shaped element. The corkscrew is also able to be driven by motors and provides that these are started automatically.
Figure 3:
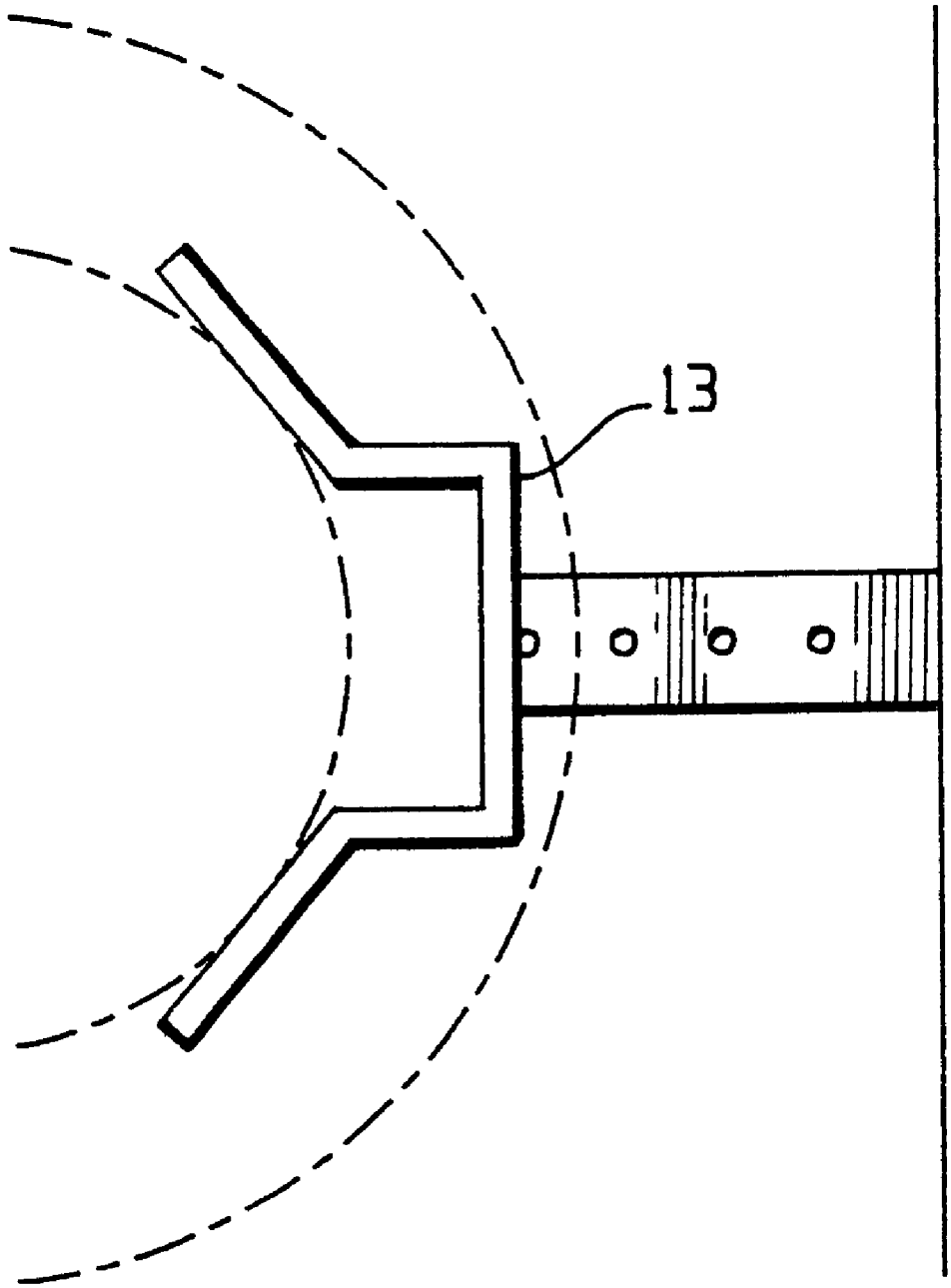
FIG. 3 is a partial cross-sectional view taken along line III—III of FIG. 2.

FIG. 2 shows the mechanical part of a wall-mounted motorized corkscrew or similar, where a guide 11 is provided for the body of the bottle located on the wall 18.

With this device it is possible to pre-arrange perfectly the centering of one type of bottle. For example for 0.75 liter bottles it is possible to fix a point where the guide satisfies the requirement of centering a Rhine-type wine-bottle and also a Burgundy-type wine-bottle.

These bottles have different body diameters but only a little, which is tolerated and hence influences the centering little or not at all.

However, since we have done so as to include, in the mouth of the corkscrew, bottle necks which go from 27 to 41 millimeters in diameter, we may find ourselves having to uncork bottles which very different capacities, and which may reach 1.5 or 2 liters or even more.

These bottles, with such differing capacities, have the body with diameters substantially different and the position of the guide must be adapted to every type. In order to do this, it will be sufficient that the V-shaped guide can slide forwards or backwards with respect to the wall and with a pin 12 or with notches or by widening the V it will be easy to find the position for each of the different types of bottle.

Reference numberal 13 denotes a support detail 11 in a plane view.

The fact that, thanks to the retractable cone 4, one can have a constant abutment for every diameter of bottle neck 9, at the base 3 of the tube 2 which collects the cork 10, allows us, in a motorized corkscrew like the one described in the above-mentioned WO-A-99-52809, to operate in such a manner that only by introducing the bottle at the base of the corkscrew and holding it thrust in abutment, do the motors start automatically to perform the uncorking operation.

To do this, the device comprises a metal rod 14, which protrudes downwardly from the base 3 of the tube 2 by a few millimeters and can slide inside the wall of the same collection tube 2.

When we thrust a bottle in abutment, the upper part of the neck 9, before reaching its end-of-travel against the base 3, will thrust the rod 14 upwards and, with the upper part of the latter, will close the contact in a switch 15 and the uncorking cycle will automatically be started.

Once the motors (not shown) have stopped, the bottle will be removed from the corkscrew, the rod 14 no longer held thrust by the neck of the bottle 9 will return to its original position thrust by a spring 16. This operation will re-open the contact of the switch 15 which will restart the motor, which drives the wormscrew 1, in the opposite direction and with that the cork 10 will be expelled from the collection tube 2 and it will be possible to repeat the operation.

If we want to make a partial removal, however, that is to say, to leave a part of the cork 10 inside the neck of the bottle 9, once we have established how much the wormscrew must penetrate inside the cork 10 and the neck 9 has been inserted into the corkscrew and thrust in abutment so as to activate the switch 15 by means of the rod 14, the uncorking will be performed automatically and at a certain point, after having removed part of the cork 10, the motors will stop. However, now we shall have the cork partly positioned inside the collection tube 2 and partly still inside the neck of the bottle 9.

Here we shall have a stalled situation since the rod 14, not being able to remove the bottle from the corkscrew, cannot return to open the circuit and restart the motor which expels the cork.

To solve this problem it will be necessary to provide a button 17 complementing the switch 15 which opens the contact manually, which will restart the motor in the opposite direction and the wormscrew 1, thus rotating, will expel from the collection tube 2 the part of the cork 10 included therein and we shall find ourselves with the bottle which has a part of the cork still inside the neck 9 which we can remove manually at the moment it has to be used.

What is claimed is:

1. A corkscrew comprising a wormscrew and a device to center and align to said wormscrew a bottle having a body and a neck of any diameter whatsoever from which the cork is to be extracted, said neck having an upper part, said device comprising:

centering means for axially centering said neck bottle with respect to said wormscrew of said corkscrew; and positioning means for positioning said wormscrew with respect to said upper part of said neck before starting a screwing operation of said wormscrew into said cork;

wherein said positioning means comprises a substantially cylindrical collecting tube, disposed substantially coaxial to said wormscrew, and said collecting tube having an abutment disposed in a lower part of said collecting tube, said abutment defining a stop reference position against said neck, a point of said wormscrew being at rest always at a same predetermined distance from said abutment, and wherein said centering means comprises an elastic means and comprises a hollow conical element coaxial to said collecting tube and axially movable with respect to said collecting tube against an action of said elastic means and able to cooperate with said upper part of said neck to axially center said neck with respect to said wormscrew, said collecting tube having an inner sidewall proximal to said wormscrew and an outer sidewall distal to said wormscrew, said hollow conical element comprises a through hole in which said lower part of said collecting tube is lodged for allowing said abutment to contact said upper part of said neck after said neck is axially centered with respect to said wormscrew, such that the hollow conical element is mounted to slide along said outer sidewall of the collection tube.

2. The corkscrew as in claim 1, wherein, said conical element comprises a retractable cone and said corkscrew is a wall-mounted corkscrew, having a base, and further comprising a guide for the body of the bottle arranged on a wall under the base of said corkscrew, for cooperating with said retractable cone to align and center said neck of the bottle perfectly with said wormscrew.

3. The corkscrew as in claim 2, wherein said guide has adjustable means to contain, align and center the body of the bottle and therefore the neck of different types with respect to the wormscrew.

4. The corkscrew comprising a wormscrew, and a device to center and align to said wormscrew a bottle having a neck of whatsoever diameter from which a cork is to be extracted, said device comprising:

a collection tube; and a receptacle cone that is associated to said collection tube, to be axially retractable with respect to said collection tube to allow said neck to abut always centered against an abutment of said collection tube in order to have a constant and determinate abutment position to correctly remove said cork;

wherein said corkscrew is motorized and a movable rod is associated to said collection tube, said movable rod being able to protrude by several millimeters beyond said abutment of said collection tube, for contacting said neck when the neck is thrust in abutment, in order to actuate a switch and automatically start an uncorking cycle.

5. The corkscrew as in claim 4, wherein a button is provided to actuate said switch to restart the corkscrew in order to expel said cork from said collection tube when a partial uncorking is required.

6. The corkscrew as according to claim 1, wherein said elastic means comprises a spring.

7. The corkscrew according to claim 1, wherein said elastic means is coaxial to said collecting tube.

8. The corkscrew according to claim 1, wherein said corkscrew is motorized and a movable rod is associated to said collection tube, said movable rod being able to protrude by several millimeters beyond said abutment of said collection tube, for contacting said neck when the neck is thrust in abutment, in order to actuate a switch and automatically start an uncorking cycle.

9. The corkscrew according to claim 8, wherein a button is provided to actuate said switch to restart the corkscrew in order to expel said cork from said collection tube when a partial uncorking is required.

10. The corkscrew according to claim 1, wherein the centering means comprises a cylindrical portion relatively proximal to the collection tube and a conical portion relatively distal to the collection tube, the cylindrical portion coaxially overlapping the collection tube, wherein the centering means is outside the collection tube, and the elastic means comprises a spring coaxially surrounding a portion of the collection tube and contacting a proximal end of the cylindrical portion of the centering means.

11. The corkscrew according to claim 10, further comprising an outer shell and the outer shell has a stopper ring located therein, wherein the collection tube extends into the outer shell, and the conical element, in an at rest position, is between the stopper ring and the spring.

12. A corkscrew comprising a wormscrew and a device to center and align to said wormscrew a bottle having a body and a neck of any diameter whatsoever from which a cork is to be extracted, said neck having an upper part, said device comprising:

centering means for axially centering said neck of said bottle with respect to said wormscrew of said corkscrew; and positioning means for positioning said wormscrew with respect to said upper part of said neck before starting a screwing operation of said wormscrew into said cork, wherein said positioning means comprises a substantially cylindrical collecting tube, disposed substantially coaxial to said wormscrew, and said collecting tube having an abutment disposed in a lower part of said collecting tube, said abutment defining a stop reference position against said neck, a point of said wormscrew being at rest always at a same predetermined distance from said abutment, and wherein said centering means comprises an elastic means and comprises a hollow centering element of progressively widening diameter to flare out downwardly relative to the collecting tube, said hollow centering element being coaxial to said collecting tube and axially movable with respect to said collecting tube against an action of said elastic means and able to cooperate with said upper part of said neck to axially center said neck with respect to said wormscrew, said collecting tube having an inner sidewall proximal to said wormscrew and an outer sidewall distal to said wormscrew, said hollow centering element comprising a through hole in which said lower part of said collecting tube is lodged for allowing said abutment to contact said upper part of said neck after said neck is axially centered with respect to said wormscrew, such that the hollow centering element is mounted to slide along said outer sidewall of the collection tube.

* * * * *